US007892621B2

(12) United States Patent
Draghici et al.

(10) Patent No.: US 7,892,621 B2
(45) Date of Patent: Feb. 22, 2011

(54) CONTAINER SCARF

(76) Inventors: Mikel Draghici, 202 Little Quarry Rd., Gaithersburg, MD (US) 20878; John Ingrassia, 705 Kent Oaks Way, Gaithersburg, MD (US) 20878

( * ) Notice: Subject to any disclaimer, the term of this patent is extended or adjusted under 35 U.S.C. 154(b) by 205 days.

(21) Appl. No.: 12/255,264

(22) Filed: Oct. 21, 2008

(65) Prior Publication Data

US 2010/0098900 A1 Apr. 22, 2010

(51) Int. Cl.
*G09F 3/04* (2006.01)

(52) U.S. Cl. ..... 428/80; 428/136; 40/310

(58) Field of Classification Search ..... 428/80, 428/99, 136; 40/310; 156/DIG. 14; 215/392
See application file for complete search history.

(56) References Cited

U.S. PATENT DOCUMENTS

| | | | |
|---|---|---|---|
| 1,837,495 | A | 12/1931 | Shaw |
| 2,048,405 | A | 7/1936 | Olsen |
| 2,092,455 | A | 9/1937 | Hoen |
| 2,145,148 | A | 1/1939 | Wolf |
| 2,139,031 | A | 12/1939 | Neher |
| 2,184,846 | A | 12/1939 | Olsen |
| 2,199,037 | A | 4/1940 | Borden |
| 2,200,616 | A | 5/1940 | Cloud |
| 2,214,436 | A | 9/1940 | Painter |
| 2,219,562 | A | 10/1940 | Painter |
| 2,221,761 | A | 11/1940 | Fairbanks |
| 2,251,022 | A | 7/1941 | Neher |
| 2,367,371 | A | 1/1945 | Painter |
| D333,639 | S | 3/1993 | Matan |

FOREIGN PATENT DOCUMENTS

| | | |
|---|---|---|
| GB | 729269 | 5/1955 |

*Primary Examiner*—Alexander Thomas
(74) *Attorney, Agent, or Firm*—Lieberman & Brandsdorfer, LLC

(57) ABSTRACT

A modified trapezoid material is provided to form a scarf configured to wrap around a neck of a container and to rest on a shoulder of a container. More specifically, the material is in the form of a trapezoid, with at least one opening in one of the parallel surfaces. The opening is sized to receive an opposite triangular portion of the material. As the triangular portion is pulled through the opening, the material forms a scarf. The size of the scarf may be adjusted based upon the desired size.

17 Claims, 7 Drawing Sheets

CONTAINER SCARF

FIELD OF THE INVENTION

This invention relates to a display device for a container. More specifically, the display device is configured to be received by the container and to contain indicia thereon.

BACKGROUND OF THE INVENTION

It is recognized that containers are generally in the form of a solid figures employed to hold various items, including liquids and solids, and come in various shapes and sizes. For containers that form a solid figure with flat surfaces, rudimentary labeling schemes may be employed to identify and/or otherwise advertise the contents of the container. However, not all containers have flat surfaces. For example, a container in the form of a sphere or a cylinder has a rounded surface. It is recognized that rounded surfaces associated with a sphere and/or a cylinder provide a greater difficulty for applying indicia.

There are different known aspects for applying indicia to a solid figure in the form of a cylinder or sphere. For example, one may apply indicia directly to the rounded surface. The negative aspect of the direct application results in the indicia having a different perception depending on it's placement along the rounded surface. The indicia that are direct on the surface may appear larger than the indicia along the surface as the curvature is applied to the surface. When placing indicia on the rounded surface, the size of the surface and perception of the indicia must be account for.

Another aspect of applying indicia to a solid figure is through a secondary label that is affixed directly to the container. The label may be applied directly to the surface of the container, which lends itself to the same or similar shortcomings of applying the indicia directly to the container surface. Furthermore, it may be desirable to employ a labeling mechanism that is not permanently affixed to the surface, or may otherwise be applied without sophisticated machining requirements. An example of such a scenario includes, but is not limited to private labeling of a container. By employing a labeling mechanism that is not embedded within the surface of the container, the labeling mechanism may be employed separately from the machining process. This process lends itself to reduced costs for producing the container, as different labeling may be applied for different customers after the machining process of the container is completed.

Therefore, there is a need for separating labeling of a container from the container itself. This supports flexibility and reduced costs with respect to manufacture of the container. In addition, there is a need for a label that can be efficiently attached to a container with a non-planar surface that overcomes the drawbacks associated with a non-planar surface.

SUMMARY OF THE INVENTION

The invention comprises a scarf for placement on a shoulder of a container in the form of a curved solid figure, for providing an economical and decorative apparatus.

In one aspect of the invention, a container scarf is provided in the form of a trapezoid material. Based upon characteristics of a trapezoid, the material includes a first surface parallel to a second surface, two non-parallel surfaces, a first wing formed by a first triangular element of the material, and a second wing formed by a second triangular element of the material. An opening is formed in the material adjacent to the first parallel surface and adjacent to one of the wings. To form the container scarf, an opposite wing is placed through the opening and over a top surface of the material.

In another aspect of the invention, a container scarf is provided in the form of a trapezoid material. Based upon characteristics of a trapezoid, the material includes a first surface parallel to a second surface, two non-parallel surfaces, a first wing formed by a first triangular element of the material, and a second wing formed by a second triangular element of the material. An opening is formed in the material adjacent to the first parallel surface and adjacent to one of the wings. To form the container scarf, an opposite wing is placed through the opening and over a top surface of the material, and through a second opening formed adjacent to the second parallel surface opposite the first opening. A display area is formed by material located between the first and second openings.

Other features and advantages of this invention will become apparent from the following detailed description of the presently preferred embodiment of the invention, taken in conjunction with the accompanying drawings.

BRIEF DESCRIPTION OF THE DRAWINGS

The drawings referenced herein form a part of the specification. Features shown in the drawing are meant as illustrative of only some embodiments of the invention, and not of all embodiments of the invention unless otherwise explicitly indicated. Implications to the contrary are otherwise not to be made.

DESCRIPTION OF THE PREFERRED EMBODIMENT

Figure 1:
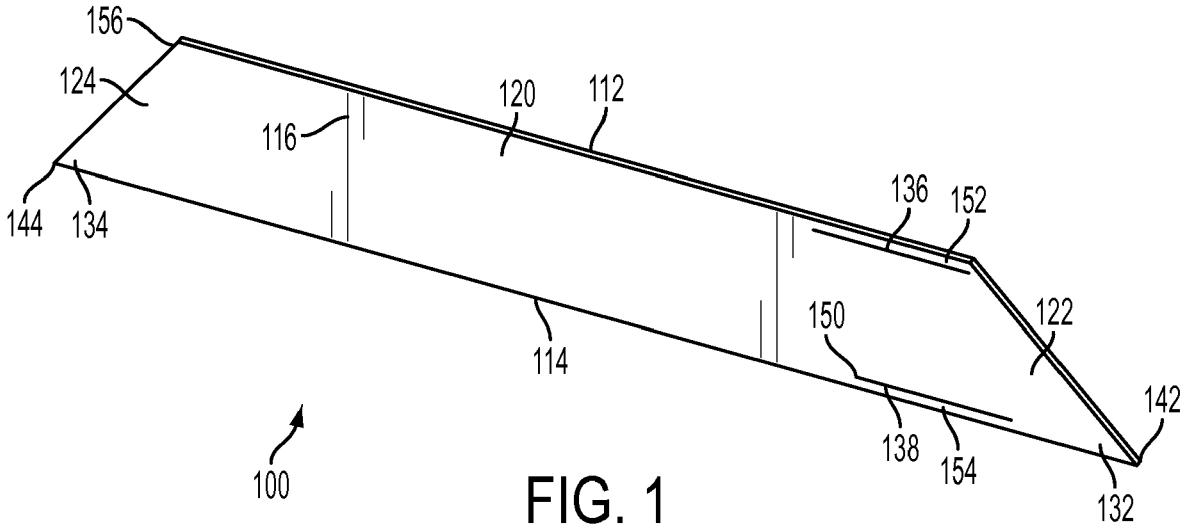
FIG. 1 is a perspective view of a scarf in a fully extended open position.

It will be readily understood that the components of the present invention, as generally described and illustrated in the Figures herein, may be arranged and designed in a wide variety of different configurations. Thus, the following detailed description of the embodiments of the apparatus, system, and method of the present invention, as presented in the Figures, is not intended to limit the scope of the invention, as claimed, but merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily referring to the same embodiment.

Furthermore, the described features, structures, or characteristics may be combined in any suitable manner in one or more embodiments. In the following description, numerous specific details are described to provide a thorough understanding of embodiments of the invention. However, one skilled in the relevant art will recognize that the invention can be practiced without one or more of the specific details, or with other methods, components, materials, etc. In other instances, well-known structures, materials, or operations are not shown or described in detail to avoid obscuring aspects of the invention.

The illustrated embodiment of the invention will be best understood by reference to the drawings, wherein like parts are designated by like numerals throughout. The following description is intended only by way of example, and illustrates certain select embodiments of devices, systems, and processes that are consistent with the invention as claimed herein.

Overview

A scarf is formed of a single piece of flexible material adapted to be folded into conical form so that it can be placed over the neck of a container or similarly shaped container and sit on the container shoulder for display and advertising purposes. The scarf retains its shape by interlocking ends produced by cutting a slit in a wing located at one end of the scarf. The scarf can be easily arranged on a container by slipping the scarf over the top of the container or by interlocking the paper ends by taking one paper wing through at least one slit cut in one surface of the material. Indicia may be placed on the material to convey information. Accordingly, the scarf is a secondary material formed from a single piece of material and sized to sit on the shoulder of a solid object, such as a container.

Technical Details

In the following description, reference is made to the accompanying drawings that form a part hereof, and which shows, by way of illustration, specific embodiments in which the invention may be practiced. It is to be understood that other embodiments may be utilized because structural changes may be made without departing from the scope of the present invention.

The invention comprises an article in the form of a scarf having a trapezoid form. As described herein, the scarf is formed from a paper stock material. Although the description of the product is in the form of a paper stock scarf, the invention should not be limited to this term. In one embodiment, the product may be in different forms of paper stock, including paper, cardboard, woven materials, etc., and the scarf may be considered as a ring or an equivalent item. Hereinafter the article will be described generically as a scarf. In a general sense, the scarf is configured as a single body that is manipulated to provide a surface for presentation of indicia, such as a label for a secondary article. Through manipulation, the scarf remains intact as a single body.

FIG. 1 is a perspective view (100) of a scarf (120) in an open position, wherein the scarf (120) is fully extended. As shown, the scarf (120) is a flat shape in the form of trapezoid. There are two extreme ends to the scarf (120). A first end (122) is on an opposite end of the scarf (120) from the second end (124). The first end (122) includes a first wing (132), and the second end (124) includes a second wing (134). Each of the wings (132) and (134) has a corner (142) and (144), respectively, with the corners facing opposite directions. The second wing (134) of the scarf (120) is non-altered. However, the first wing (132) has alterations thereto to accommodate formation of the scarf (120). More specifically, the trapezoid shaped scarf (120) includes two parallel surfaces (112) and (114), with a first surface (112) shorter in length from the second surface (114). The first surface (112) has a first opening (136) formed therein, and the second surface (114) has a second opening (138) formed therein. Based upon the properties of the scarf (120), the first opening (136) and the second opening (138) are elongated and parallel. The scarf (120) is formed by wrapping the second wing (134) through the first and second openings (136) and (138).

More specifically, the first opening (136) and the second opening (138) are each formed near the respective parallel surfaces (112) and (114). There is a first section of material (152) formed between the first opening (136) and surface (112). Similarly, there is a second section of material (154) formed between the second opening (138) and surface (114). In one embodiment, the sections of material (152) and (154) are shown as being relatively narrow with respect to the width from the opening (136) and (138) to the associated surface (112) and (114), respectively. However, the invention should not be limited to the width of the sections of material (152) and (154) illustrated herein. In one embodiment, the width of sections (152) and (154) may be proportionally increased relative to the size of the scarf (120). Similarly, in one embodiment, the width of sections (152) and (154) may not be equal. For example, the width of section (152) may be greater than or less than the width of section (154). Furthermore, each of the first and second openings (136) and (138) are each separately sized to accommodate receipt of the second wing of the scarf (134). More specifically, as the second wing (134) is placed through the first and second openings (136) and (138), the body of the scarf (120) follows through the openings (136) and (138). As noted above, the scarf (120) is shown in the shaped of a trapezoid, with the height (116) of the scarf (120) being uniform across the body based upon the characteristics of a trapezoid. To accommodate receipt of the second wing (134) and a portion of the body of the scarf (120), the first and second openings (136) and (138) are sized to at least the height (116) of the scarf (120). In one embodiment, one or both of the first and second openings (136) and (138) may be sized greater than the height (116) of the scarf (120).

To form the scarf (120) from the material in the form of a trapezoid, the second wing (134) is woven through the first and second openings (136) and (138). More specifically, the second wing (134) is initially placed under the first section of material (152) and through the first opening (136). The second wing (134) is pulled through the first opening (136), with a portion of the body of the scarf (120) following the first wing (132) through the opening. Thereafter, the second wing (134) is placed through the second opening (138) and under the second section of material (154). In one embodiment, the second wing (134) is pulled through the second opening (138) until the top corner (156) of the trapezoid is at or near the corner (150) of the second opening (138). Accordingly, once the second wing (134) is woven through both the first and second openings (136) and (138), the trapezoid shaped material forms a scarf (120).

Figure 2:
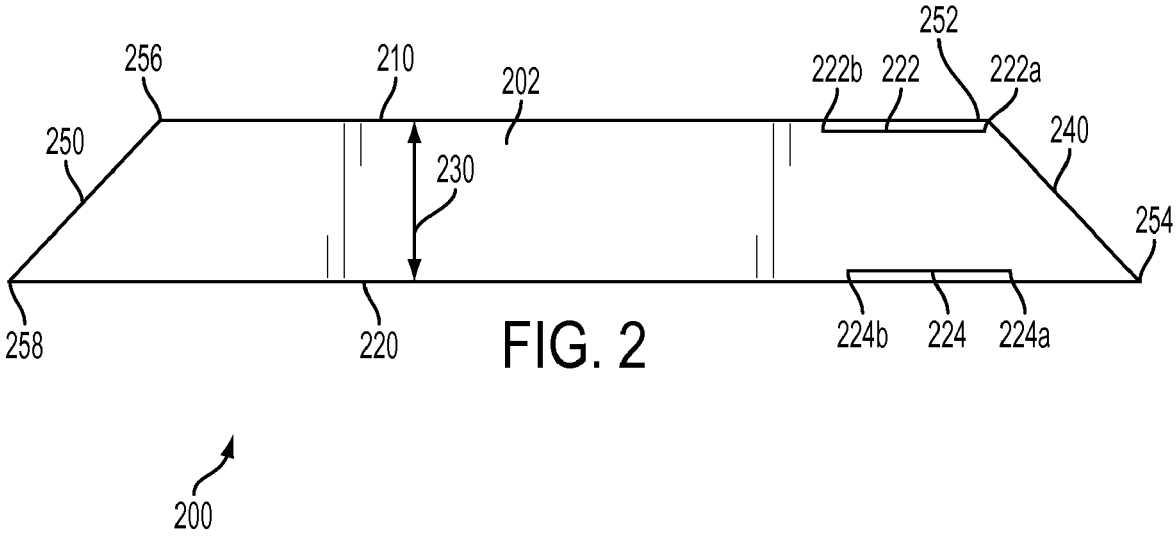
FIG. 2 is a front elevation view taken from FIG. 1.

FIG. 2 is a front elevation view (200) taken from FIG. 1. More specifically, the front elevation view shows the material employed to form the scarf prior to formation thereof. As shown, the material (202) is in the shaped of a trapezoid. There are two parallel surfaces, a first surface (210) and a second surface (220), with a height (230) separating the two surfaces. In addition, there are two opposite but non-parallel surfaces, a first non-parallel surface (240) and a second non-parallel surface (250). A first corner (252) is formed between the first parallel surface (210) and the first non-parallel surface (240); a second corner (254) is formed between the second parallel surface (220) and the first non-parallel surface (250); a third corner (256) is formed between the first parallel surface (240) and the second non-parallel surface (250); and a fourth corner (258) is formed between the second parallel surface (220) and the second non-parallel surface (250). As shown, a first opening (222) is formed in the first parallel surface (210), and a second opening (224) is formed in the second parallel surface (220). Based upon the principles of a trapezoid, the first and second openings (222) and (224) are parallel. As noted above, the first and second openings (222) and (224), respectively, are sized to accommodate the height (230) of the trapezoid, i.e. the distance formed between the first and second parallel surface (210) and (220), respectively. In one embodiment, the first and second openings (222) and (224) have an equal size. However, the invention should not be limited to this sizing, as the first and second openings (222) and (224) can have different sizes, with the minimum size for each being the height (230). Similarly, in one embodiment, the first and second openings (222) and (224) are aligned. More specifically, first opening (222) has a first end (222*a*) and a second end (222*b*) with the first end (222*a*) closer to the first non-parallel surface (230) and the second end (222*b*) having a greater distance to the first non-parallel surface (240). The second opening (224) has a first end (224*a*) and a second end (224*b*) with the first end (224*a*) closer to the first non-parallel surface (240) and the second end (224*b*) having a greater distance to the first non-parallel surface (240). In one embodiment, the first opening (222) and the second opening (224) are aligned so that when the trapezoid is in a flat and extended position, the first openings (222*a*) and (224*a*) are linearly aligned, and the second openings (222*b*) and (224*b*) are linearly aligned. However, the invention should not be limited to the alignment of the openings. Accordingly, the openings (222) and (224) are formed to receive the second corner (258) of the material (202), and to transform the material in the form of a trapezoid into a scarf.

Figure 3:
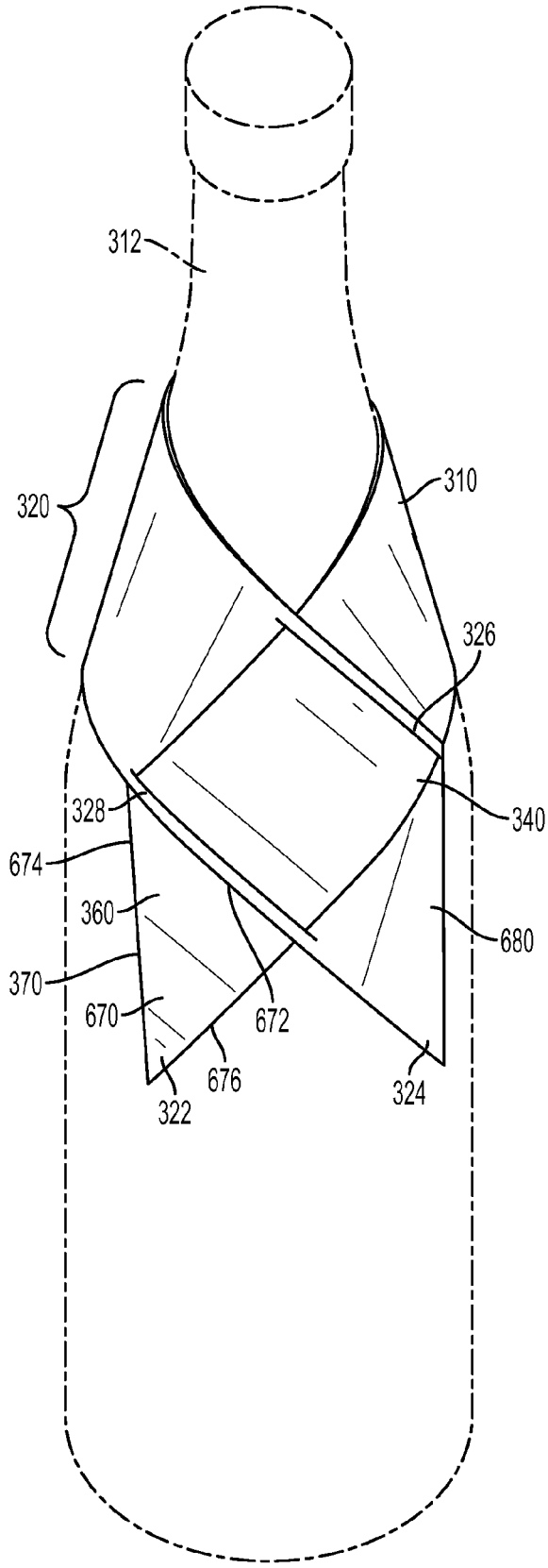
FIG. 3 is a perspective view of a scarf formed from the trapezoid material of FIGS. 1 and 2, according to the preferred embodiment of this invention, and is suggested for printing on the first page of the issued patent.

FIG. 3 is a perspective view (300) of a scarf (310) formed from the trapezoid material of FIGS. 1 and 2. As shown herein, the scarf (310) is placed on a solid object (312), such as a container. The body (320) of the scarf (310) is shown wrapped around a neck of the solid object (312). More specifically, as shown, a first corner (322) and a second corner (324) of the scarf (310) are in an adjacent setting. To form the scarf (310), the first corner (322) is placed under a first surface (326) and under a second surface (328), while extending over a portion of the body (330) between the first and second surface (326) and (328). A portion (340) of the scarf (310) rests between the first surface (326) and the second surface (328). More specifically, the area between the first and second surfaces (326) and (328), form a display area (340). In one embodiment, indicia may be placed on a surface of the scarf (310) in the display area portion (340). Similarly, in one embodiment, the display area (340) is in the shape of a square. This enables information to be conveyed in the display area (340) to observers of the object. For example, in one embodiment, the indicia that is conveyed in the display area (340) is not affected by placement of the scarf on a non-planar surface, as the display area (340) forms a substantially planar surface within the body of the scarf (310). Furthermore, in one embodiment, indicia may also be placed on one or both of the corners (322) and (324). However, the invention should not be limited to placement of indicia on the display area (340) and one or both of the corners (322) and (324), as indicia may be placed on any portion of the material that forms the scarf (310). Accordingly, formation of the scarf (310) for placement on a solid figure with a non-planar surface supports placement of indicia on a secondary surface that is received or accommodated to be received by the solid figure, and the non-planar surface thereof.

Figure 4:
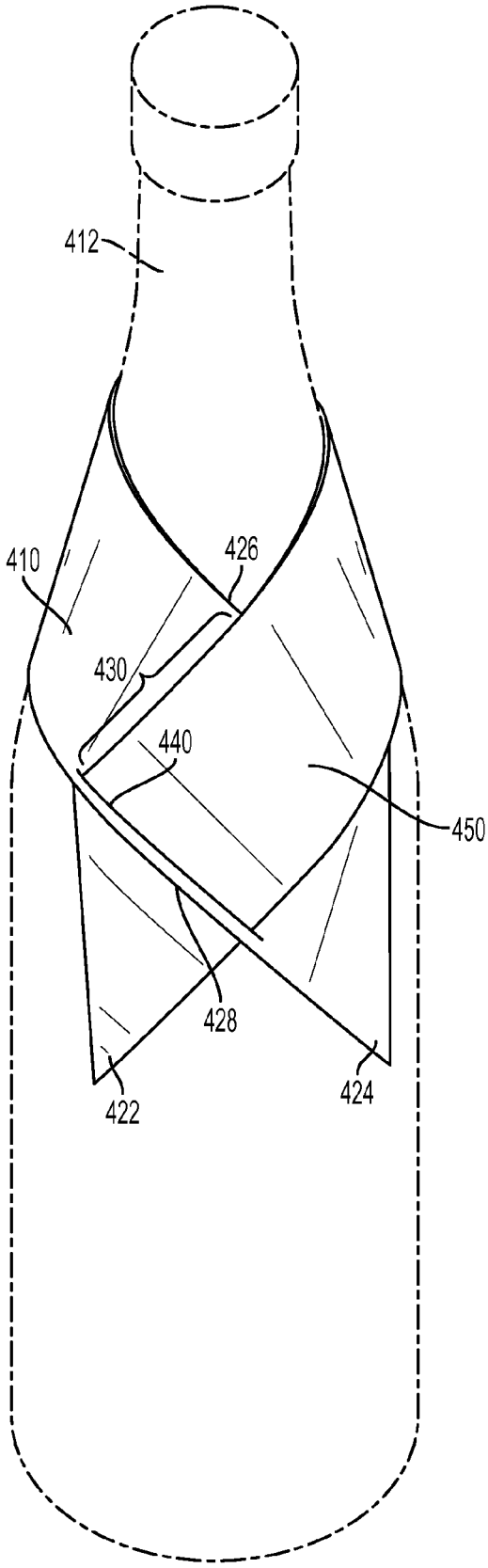
FIG. 4 is a perspective view of the scarf formed from a trapezoid material.

As shown in FIGS. 1-3, the material that forms the scarf is shown with two parallel openings to accommodate a weave of one corner of the trapezoid through both openings. However, the invention should not be limited to the requirement of two openings. In one embodiment, the trapezoid may be employed with formation of a single opening. FIG. 4 is a perspective view (400) of the scarf formed from a trapezoid material. As shown herein, the scarf (410) is placed on a solid object (412), such as a container. The body of the scarf (410) is shown wrapped around the neck of the solid object (412). More specifically, as shown, a first corner (422) and a second corner (424) of the scarf (410) in an adjacent setting. To form the scarf (410), the first corner (422) is placed under a first opening (440) that forms a second surface (428), while extending over a portion of the body (430) between the second surface (428) and a top parallel surface (426). The area between the second surface (428) and the top parallel surface (426) form a display area (450). In one embodiment, the display area (450) formed by use of a single first opening (440) is larger than the display area (340) shown in the embodiment of FIG. 3 as there is no restriction of spacing between two openings. Accordingly, a scarf (410) may be formed with a trapezoid shaped material and a single opening employed to receive a corner of the trapezoid.

Figure 5:
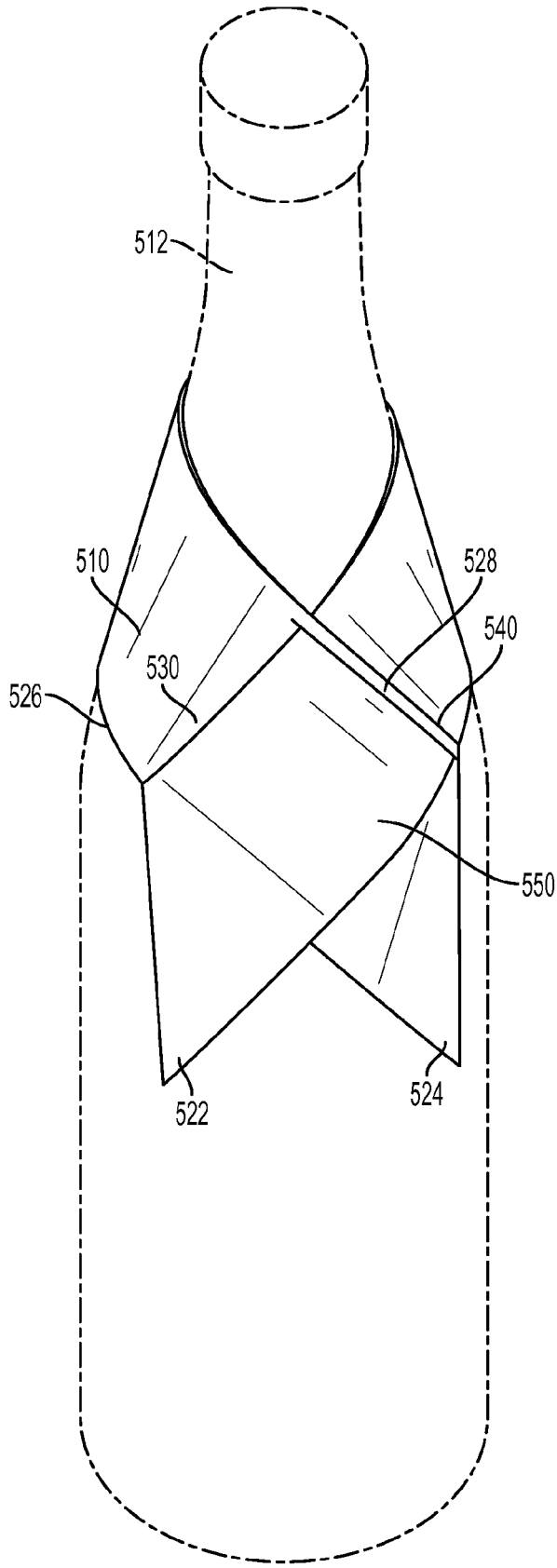
FIG. 5 is a perspective view of the scarf formed based upon the embodiment of FIG. 4.

The embodiment of FIG. 4 employs a single opening to form a scarf (410) with the opening formed near the second surface of the trapezoid material, wherein the second surface is the longer of the two elongated parallel surfaces. In one embodiment, the scarf (410) may be formed with a single opening formed on the opposite of the two parallel surfaces, i.e. the shorter of the two parallel surfaces. FIG. 5 is a perspective view (500) of the scarf formed based upon the embodiment of FIG. 4. More specifically, as shown, the scarf (510) is placed on a solid object (512), such as a container, i.e. wrapped around the solid object (512). More specifically, as shown, a first corner (522) and a second corner (524) of the scarf (510) are in an adjacent setting. To form the scarf (510), the first corner (522) is placed under a first opening (540) that forms a first surface (528). The first corner (522) is placed through the first opening (540) and extends over a portion of the body (530) including a bottom parallel surface (526). The area between the first opening (540) and the bottom parallel surface (526) form a display area (550). In one embodiment, the display area (550) formed by use of a single first opening (540) is larger than the display area (340) shown in the embodiment of FIG. 3 as there is no restriction of spacing between two openings. Accordingly, a scarf (510) may be formed with a trapezoid shaped material and a single opening employed to receive a corner of the trapezoid, wherein the single opening is formed on a surface opposite that shown in the embodiment of FIG. 4.

Figure 6:
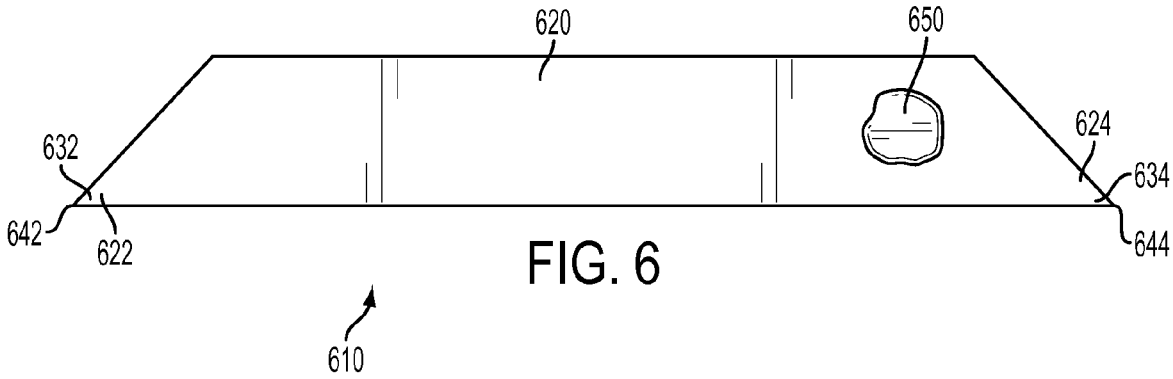
FIG. 6 is a bottom perspective view of a scarf in an open and fully extended position.

As shown in FIGS. 1-5, the scarf is formed with the use of one or two openings on opposite parallel surfaces of a trapezoid. In one embodiment, the scarf may be formed with the same trapezoid material, without employing the openings formed adjacent to the parallel surfaces and without weaving one corner of the trapezoid through one of the openings. FIG. 6 is a bottom perspective view (610) of a scarf (620) in an open position, wherein the scarf (620) is fully extended. As shown, the scarf (620) is a flat shape in the form of trapezoid. There are two extreme ends to the scarf (620). A first end (622) is on an opposite end of the scarf (620) from the second end (624). The first end (622) includes a first wing (632), and the second end (624) includes a second wing (634). Each of the wings (632) and (634) has a corner (642) and (644), respectively, with the corners facing opposite directions. A top surface (not shown) of each of the wings (632) and (634) of the scarf (620) are non-altered. As shown, the bottom surface of the scarf (620) contains an alteration. More specifically, as shown, the bottom surface of the scarf (620) adjacent to the second wing (634) has an adhesive composition (650) applied thereto. In one embodiment, the adhesive (650) may be spread across the bottom surface that is to be placed across and secured to the top surface to form the scarf. The trapezoid shaped material (620) is formed into a scarf as the first wing and the second wing (632) and (634), respectively, are brought towards each other, with the bottom surface of the second wing (634) placed over a top surface of the first wing (632). In one embodiment, the arrangement of the adhesive composition may be reversed. More specifically, the adhesive composition may be placed on the bottom surface of the scarf adjacent to the first wing (632), with the scarf formed by placement of the bottom surface of the first wing (632) over the top surface of the second wing (634). Accordingly, the adhesive material (650) secures the bottom surface of one of the wings (632) or (634) to the top surface of the opposite wing to form a scarf (602).

In each of the embodiments shown herein, a scarf is formed from a flat trapezoid material with a display area or surface formed for placement of indicia. For the embodiments that use the adhesive material or a single opening, the display area does not contain borders formed by the openings. However, the display area may be measured by formation of the wings. More specifically, as shown in FIG. 3, the wing portion (360) that extends beyond the second surface (328) forms a triangle (670). The hypotenuse of the triangle (672) is the first non-parallel side of the trapezoid figure. A first side (674) of the other two sides of the triangle (670) is formed by the material extending from the second opening (328) adjacent to the first parallel surface to the corner (322). The second side (676) of the other two sides of the triangle (670) is formed by the material extending from the second parallel surface (328) to the corner (322). In one embodiment, the triangle (670) formed by the corner (322) is a right triangle. However, the invention should not be limited to formation of a right triangle. Similarly, in addition to the formation of triangle (670), also known as the first triangle, a second triangle (680) is formed in an opposite manner of the first triangle (670). In one embodiment, the first and second triangles (670) and (680) are similar triangles, based upon the geometric principles of similar triangles. In one embodiment, the size of the first and second triangle (670) and (680), respectively, may be the triangular portions of the trapezoid, with the remaining portions of the trapezoid being the rectangular element of the material between the two triangular ends.

Figure 7:
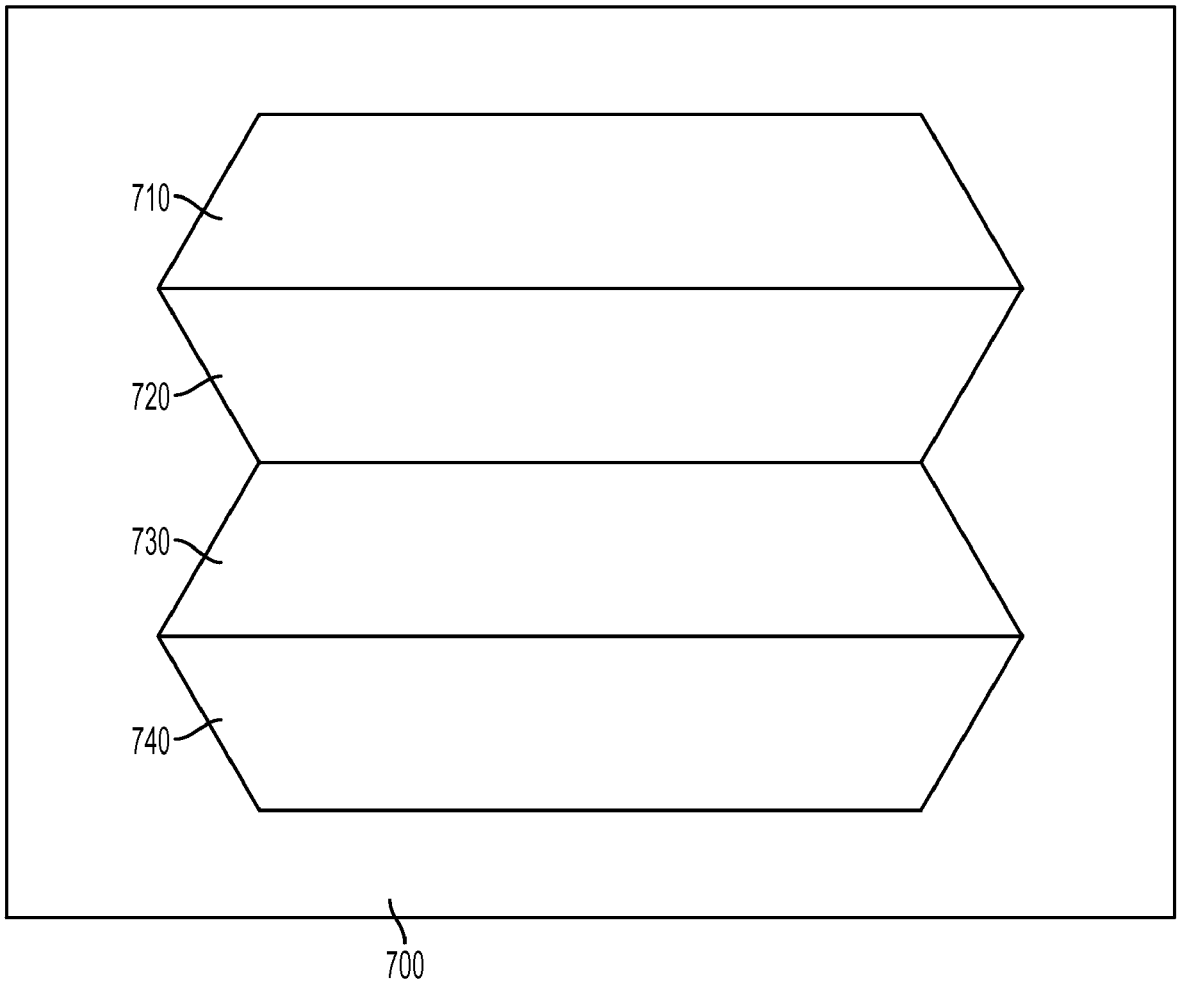
FIG. 7 is a top view of a planar surface employed for creating the scarf.

Similarly, in one embodiment the scarp may be manufactured on a single sheet with multiple perforations to delineate the individual scarves. FIG. 7 is a top view of a sheet (700) employed for creating the scarf. As shown, there are multiple planar arrangements of the scarf (710), (720), (730), and (740) adjacently arranged on the planar surface of the sheet (700). The invention should not be limited to the quantity of scarves shown on sheet (700). Each sheet may be configured with a different quantity of scarves than those shown herein. Perforations are employed to separate the adjacently arranged scarves (710)-(740). The scarves may be detached from the sheet (700) through the perforations. In addition, the scarf may be configured with the embodiments shown in FIGS. 1-5, and provided with indicia to show where the opening(s) in the scarf should be formed to receive the wing and to transform the planar arrangement of the scarf to the three dimensional form of the scarf. In one embodiment, the arrangement of the scarves on the sheet (700) may alternate positions so that one set of trapezoids have the elongated parallel sides adjacently arranged, followed by the shorter parallel sides of the next set of adjacent trapezoids being adjacently arranged. Accordingly, the embodiment shown herein is only one form of arranging the material on a planar surface for manufacture of the scarf.

Advantages Over the Prior Art

Formation of a scarf from a planar material for placement on a solid object with non-planar surfaces supports placement of indicia on the solid object without the restrictions associated with placement of indicia on a non-planar surface. Furthermore, there is no requirement for a secondary securing material to be employed to form the scarf. Rather, the scarf may be formed by weaving portions of the trapezoid material. Indicia may be placed at any location on the trapezoid material. Although in one embodiment, it may be desirable to place specific indicia within the formed display area and perhaps alternative indicia on an exterior surface of the portion of the scarf that is on the opposite surface of the solid object. The scarf not only provides a secondary surface for conveyance of indicia to a solid object, but also functions as an item to decorate the solid object. The scarf is not secured to the solid object. Rather, the scarf is sized to fit around the non-planar surfaces of the solid object. As shown in the Figures herein, in one embodiment, the scarf is sized to fit around the neck of a container to decorate and/or convey information.

Alternative Embodiments

It will be appreciated that, although specific embodiments of the invention have been described herein for purposes of illustration, various modifications may be made without departing from the spirit and scope of the invention. In particular, in one embodiment, an adhesive material may be placed on the bottom surface of the formed scarf so that the scarf may be secured to the solid surface following placement thereon. Similarly, as the triangular portion of the material is pulled through the opening, the material forms a scarf with a circumference. The size of the scarf circumference may be adjusted by pulling more of the material through the opening or less of the material through the opening. More specifically, a larger circumference will require less material to be placed through the opening, whereas a smaller circumference will require more material to be placed through the opening. Accordingly, the scope of protection of this invention is limited only by the following claims and their equivalents.

We claim:

1. A container scarf comprising:

a trapezoid material with a first surface parallel to a second surface, two non-parallel surfaces, a first wing formed by a first triangular element of the material, and a second wing formed by a second triangular element of the material;

an opening formed in the material adjacent to the first parallel surface and adjacent to one of the wings; and an opposite wing placed through the opening and over a top surface of the material.

2. The container scarf of claim 1, further comprising a second opening formed adjacent to the second parallel surface opposite the first opening.

3. The container scarf of claim 2, further comprising placement of the opposite wing placed through the second opening.

4. The container scarf of claim 3, further comprising a display area formed by material located between the first and second openings.

5. The container scarf of claim 4, wherein said display area has a square shape.

6. The container scarf of claim 4, further comprising an adhesive material placed on a bottom surface of the display area to secure the display area to a secondary surface.

7. The container scarf of claim 4, further comprising an adhesive material placed on a bottom surface of the trapezoid material located between the two wings to secure the trapezoid material to a secondary surface.

8. The container scarf of claim 4, further comprising indicia on a top surface of the display area.

9. The container scarf of claim 1, further comprising said first wing in a shape of a first triangle, and a second wing in a shape of a second triangle.

10. The container scarf of claim 9, wherein said first and second triangles are similar triangles.

11. A container scarf comprising:

a trapezoid material with a first surface parallel to a second surface, two non-parallel surfaces, a first wing formed by a first triangular element of the material, and a second wing formed by a second triangular element of the material;

an opening formed in the material adjacent to the first parallel surface and adjacent to one of the wings;

an opposite wing placed through the opening and over a top surface of the material;

a second opening formed adjacent to the second parallel surface opposite the first opening;

placement of the opposite wing placed through the second opening; and a display area formed by material located between the first and second openings.

12. The container scarf of claim 11, wherein said display area has a square shape.

13. The container scarf of claim 11, further comprising an adhesive material placed on a bottom surface of the display area to secure the display area to a secondary surface.

14. The container scarf of claim 11, further comprising an adhesive material placed on a bottom surface of the trapezoid material located between the two wings to secure the trapezoid material to a secondary surface.

15. The container scarf of claim 11, further comprising indicia on a top surface of the display area.

16. The container scarf of claim 11, further comprising said first wing in a shape of a first triangle, and a second wing in a shape of a second triangle.

17. The container scarf of claim 16, wherein said first and second triangles are similar triangles.

* * * * *